United States Patent [19]

Vandame

[11] Patent Number: 4,696,530

[45] Date of Patent: Sep. 29, 1987

[54] FEMALE ELECTRICAL CONTACT ELEMENT

[75] Inventor: Bertrand Vandame, Villepreux, France

[73] Assignee: Precision Mechanique Labinal, Bois d'Arcy, France

[21] Appl. No.: 927,189

[22] Filed: Nov. 5, 1986

[30] Foreign Application Priority Data

Nov. 5, 1985 [FR] France ..... 85 16351

[51] Int. Cl.[4] ..... H01R 13/62

[52] U.S. Cl. ..... 439/266; 439/849

[58] Field of Search ..... 339/74 R, 256 SP, 258 F, 339/258 S

[56] References Cited

U.S. PATENT DOCUMENTS

| | | | |
|---|---|---|---|
| 4,076,369 | 2/1978 | Ostapovitch | 339/258 R |
| 4,478,470 | 10/1984 | Fruchard et al. | 339/258 S |
| 4,482,199 | 11/1984 | Karl | 339/258 S |
| 4,564,259 | 1/1986 | Vandame | 339/258 R |

FOREIGN PATENT DOCUMENTS

| | | |
|---|---|---|
| 1615966 | 6/1970 | Fed. Rep. of Germany . |
| 2710165 | 9/1978 | Fed. Rep. of Germany . |
| 2415890 | 8/1979 | France . |
| 0626449 | 10/1961 | Italy . |
| 2010602 | 6/1979 | United Kingdom . |
| 1584571 | 2/1981 | United Kingdom . |

*Primary Examiner*—Joseph H. McGlynn

*Attorney, Agent, or Firm*—Sandler & Greenblum

[57] ABSTRACT

A female electrical contact element is fabricated from thin sheet metal that is resilient and a good conductor of electricity. The metal sheet is cut into a blank which is adapted to be folded into an arrangement of parts at one end for connecting the female electrical contact element to an electrical conductor and into a channel at another end adapted to receive a flat male contact member. The channel portion of the female electrical contact element includes a base, two side walls and a top wall. An elongate section of the top wall extends from the end of the top wall opposite the connecting arrangement and is folded inside the channel. The elongate section has a free end folded into a catch which is hook-shaped and adapted to protrude through an opening in the base. The elongate section of the top wall also has an elongate slot with a longitudinal part and a transverse part opening into an edge of the elongate section which divides the elongate section into two tangs. A first tang is adapted to make electrical connection with a male member and the second tang is integral with the catch and is adapted to engage with the male member.

9 Claims, 5 Drawing Figures

2C
11
8
5
6
12
7
7a
5
6
1
21
9
15b
13a
17
14a
24
15
20
15a
10
14
14b
13
13b
19
18
13b
10a
2

6
5
12
11
21
4a
10
20
8
4
9
7
27
28

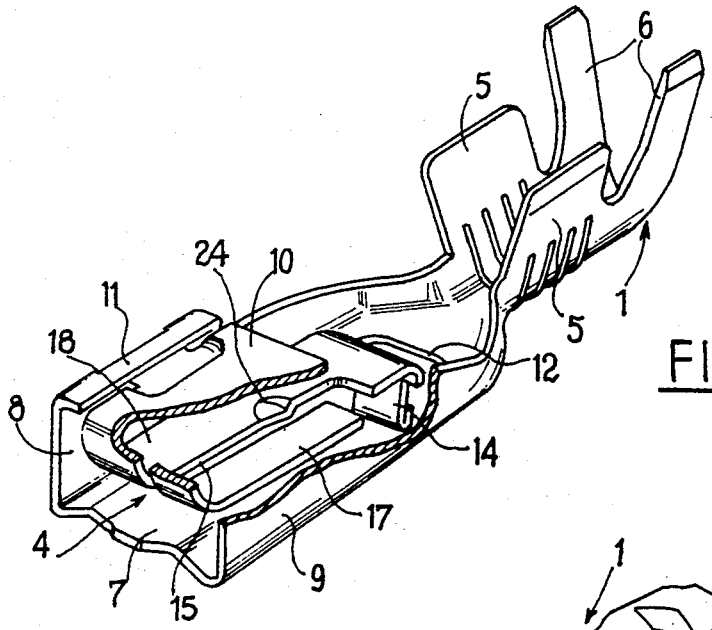
FIG.3
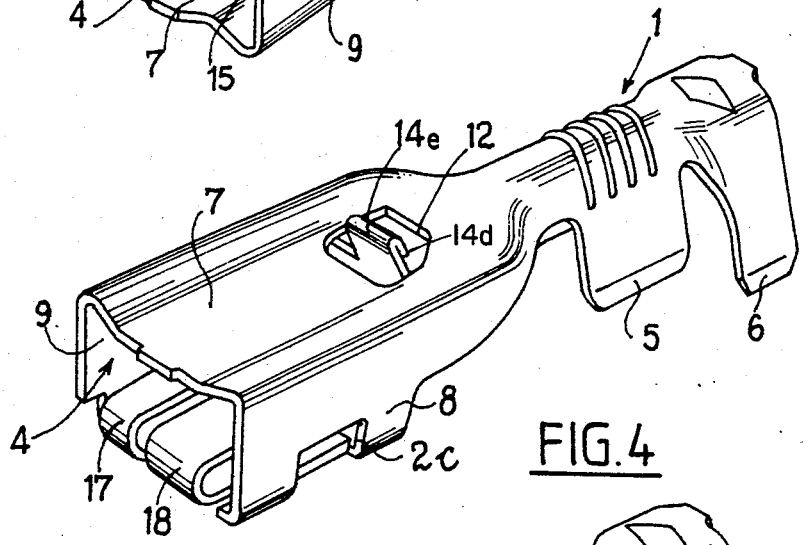
FIG.4
FIG.5
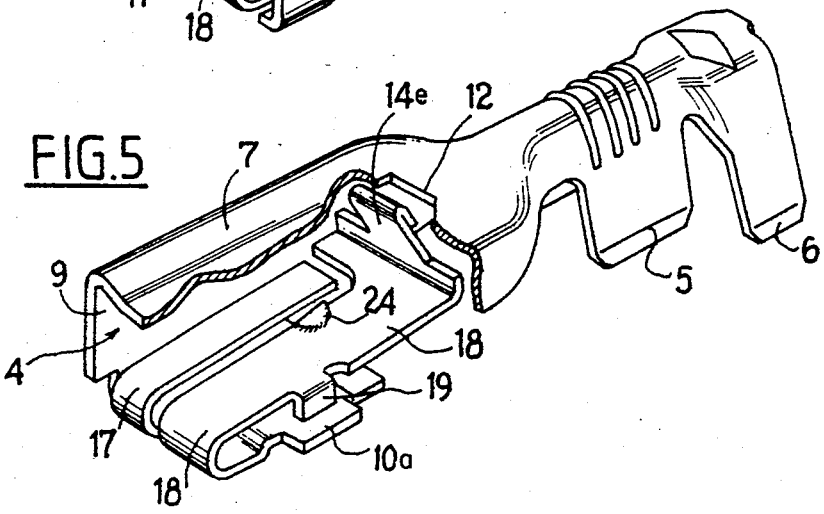

FEMALE ELECTRICAL CONTACT ELEMENT

BACKGROUND OF THE INVENTION

1. Field of the Invention

The present invention relates to electrical connectors. In particular, the present invention is directed to a female element of an electrical connector which is adapted to be fitted to one end of an electrical conductor and to receive a corresponding male member having a generally flat cross-section which is also connected to an electrical conductor. The female element and the male member are adapted to be accommodated in complementary insulative housings.

2. Discussion of Background and Material Information

The prior art includes electrical contact elements including means for connection to an electrical circuit at one end while the other end is in the form of a channel having a resilient or elastic strap, integral with or attached to the channel. Such female contact elements serve to grip male contact members in order to make an electrical connection and complete the electric circuit. An example of such female electrical contact element is disclosed in U.S. Pat. No. 4,564,259, commonly owned with the present application. In brief, the female electrical contact element of U.S. Pat. No. 4,564,259 includes a resilient or elastic strap having a first section positioned against the base side of the channel portion of the female electrical contact element, and a second section which is substantially U-shaped with a free end inclined at an acute angel with respect to the base side. When a male member of an electrical connector is inserted into the previously described female contact element, the male member is clamped between the free end and the first section of the strap. The first section of the strap preferably has a slight identation adapted to cooperate by bearing against the side opposite the base side of the channel so as to ensure that a firm electrical connection in achieved, particularly in the case when the male member is relatively thin.

SUMMARY OF THE INVENTION

An object of the present invention is to provide a female electrical contact element fabricated from thin sheet metal that is resilient and a good conductor of electricity having an anterior portion at one end including means for attachment to an electrical conductor, and a posterior portion at an opposite end including a channnel adapted to receive a male contact member. The channel is preferably rectangular in transverse cross-section and includes a base, two side walls attached to the base, and a top wall attached to at least one of the side walls. The top wall has an extended portion with a free end folded so as to be positioned between the top wall and the base which is preferably provided with an opening adapted to receive the free end when the extended portion of the top wall is folded within the channel. The extended portion of the top wall preferably includes a slot having a generally elongate area dividing the portion into two elongate members. The elongate area of the slot preferably has a longitudinal axis parallel to a longitudinal axis of the extended portion of the top wall, and also includes a transverse area having an axis offset by an angle from the longitudinal axis which opens into an edge of the extended portion of the top wall. The two elongate members preferably include a first shorter member, adapted to make electrical contact with a male electrical contact member, and a second longer member which is preferably integral with the free end of the extended portion of the top wall, and is adapted to be engaged by a male electrical contact member. The free end of the extended portion is folded into a catch, which is preferably hook-shaped, adapted to protrude through the opening located, preferably in a forward area in the vicinity of the anterior portion of the female electrical contact element, in the base when the female electrical contact element is engaged by a male electrical contact member.

Another object of the present invention is to provide a female electrical contact member, as described above, wherein the longer member of the extended portion of the top wall has a boss on a side facing the base, preferably projecting from an area of the base along an edge of the extended portion adjacent the slot.

Another further object of the present invention is to provide a female electrical contact member, as described above, wherein the longer member of the extended portion has a lug folded, preferably to extend from an edge of the longer member opposite the slot, towards the top wall of the channel.

Another still further object of the present invention is to provide a female electrical contact member, as described above, wherein the top wall is provided with a lug cut-out which is folded towards the interior of the channel and the shorter member of the extended portion of the top wall.

Another yet still further object of the present invention is to provide a blank of sheet metal adapted to be formed into a female electrical contact element having a posterior portion shaped into a channel for receiving a male contact member and an anterior portion adapted to be attached to an electrical conductor. The blank includes a base section, including a forward extension having lateral projections adapted to be shaped into the anterior portion of the female electrical contact element, which acts as a base panel of the channel, a first side section and a second side section integral with the base section and adapted to be formed into first and second side panels of the channel, a flange section integral with the first side section adapted to be formed into a top wall panel of the channel, and a top wall section including a rearward extension terminating in a free end adapted to be formed into a top wall panel of said channel. The rearward extension of the top wall section preferably includes a first shorter elongate member and a second longer elongate member integral with the free end of the rearward extension. The base section is preferably provided with an opening adjacent the forward extension. The second longer elongate member of the rearward extension of the top wall section is provided with a lateral projection adapted to be formed into a lug. The second side panel section and the top wall section have a cut-out area adapted to be formed into a lug. The first side wall section has a notched-out area and the top wall section is provided with a lateral tab adapted to fit within the notched-out area upon formation of the channel. The second longer elongate member of the rearward extension preferably has an area adapted to be formed into a boss.

BRIEF DESCRIPTION OF THE DRAWINGS

FIG. 3 is a partially cut away perspective view of the female contact element shown in FIG. 2.

FIG. 4 shows the female contact element in perspective from below.

FIG. 5 is a partially cut away perspective view of the female contact element corresponding to FIG. 4.

DESCRIPTION OF THE PREFERRED EMBODIMENT

An object of the present invention is to provide a female electrical contact element of simple design having a structure which is particularly suitable for obtaining a good electrical connection to a corresponding male member.

The present invention is directed to a female electrical contact element fabricated from thin sheet metal. The metal used to fabricate the thin sheet should be a good conductor of electricity. The thin metal sheet is preferably resilient, and is cut and folded so as to include means for connecting the element to an electrical conductor at one end and a channel adapted to receive a substantially flat male contact member at an opposite end. The channel is constructed to have a rectangular transverse cross-section including a base, two side walls, a top wall, an extension of the top wall extending from the side of the top wall opposite the connecting means and adapted to be folded inside the channel, a catch in the shape of a hook at a free end of the extension, an opening in the base through which the hook passes, and a slot in the extension. The slot in the extension includes a longitudinal part and a transverse part which opens into an edge in the vicinity of an end of the extension. The slot divides the extension into two tangs. A first tang is adapted to make an electrical connection with a male electrical contact member and a second tang is integral with the hook and is adapted to be engaged by the male member.

In one embodiment of the present invention, the second tang has a boss on the side facing the base. The second tang also preferably has a lug on its side folded towards the top wall. This lateral lug thus constitutes an abutment member preventing the second tang from being folded to an extent beyond which the tang would loose its elasticity. The top wall preferably includes a lug cut out and folded towards the first tang which functions in a similar manner. This arrangement prevents the first tang from being forced on inserting the male mamber.

The invention will now be described in more detail by way of example ony by referring to a specific embodiment shown in the appended drawings.

Figure 1:
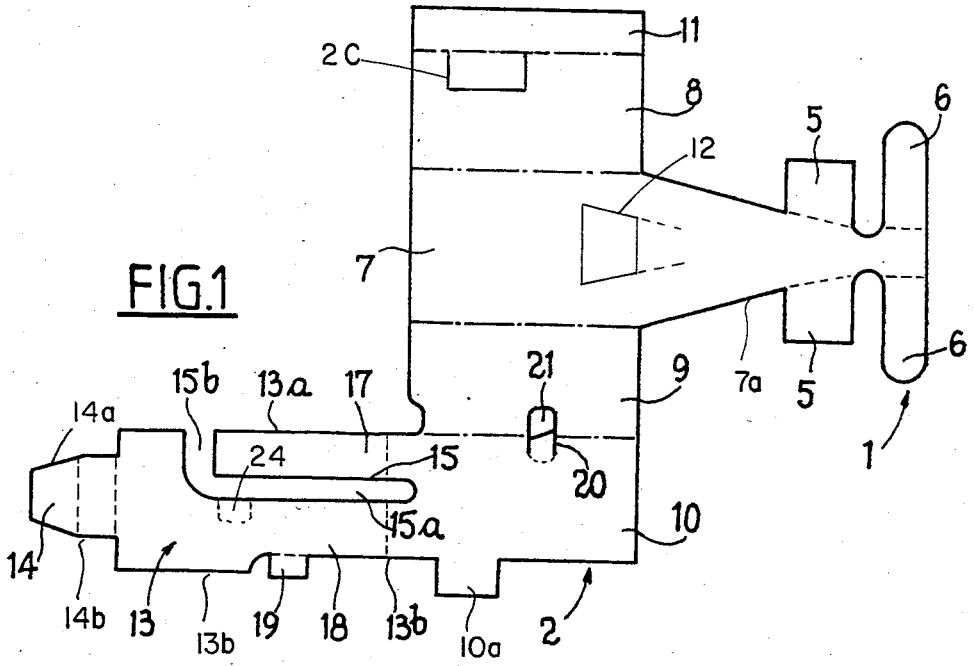
FIG. 1 is a plane view showing the female contact element blank cut out from a strip.

FIG. 1 shows part of a metal strip appropriately cut out in the form of a blank adapted to be folded into the finished shape of the female electrical contact element in accordance with the invention. The female electrical contact element blank has a portion 1 adapted to be folded into a connecting means and a portion 2 adapted to be folded so as to form a channel 4.

The connecting means 1 are formed by tabs 5 and 6. Preferably, the tabs 5 are adapted to be crimped onto a bared end of an electrical conductor and the tabs 6 are adapted to be crimped onto the sheath of the conductor.

The portion 2 of the blank has a section adapted to form a base wall 7, two sections adapted to form side walls 8 and 9, a section adapted to form a top wall 10 and a section adapted to form a flange 11 of the female electrical contact element of the present invention.

The base wall section 7 has a tapered section **7*a* and is stamped to have an opening 12**.

The top wall section 10 is generally elongate and includes a section in the form of an extension 13 terminating in a free end adapted to be folded into a catch which may be in the form of a hook 14. The section forming extension 13 is provided with a slot 15 including an area **15*a* extending substantially along the longitudinal axis of the extension and an area 15*b* which opens onto an edge 13*a* of the extension 13. The slot 15 divides the section forming the extension 13 into two elongate members adapted to be folded into tangs 17 and 18. The section of the blank which forms extension 13 has a lateral projection on an edge 13*b* opposite the edge 13*a* adapted to be folded to form lug 19**.

The sections forming top wall 10 and side wall 9 include a cut-out 20 adapted to form a lug 21.

The section adapted to form tang 18 is provided with a boss 24 protruding from a surface side of extension 13, shown in phantom in FIG. 1 and more clearly in FIG. 4 which illustrates the blank folded into its finalized configuration as a female electrical contact element. The boss 24 is adapted to cooperate with a hole 27 in a male contact member 28 (shown in FIG. 2) designed to be inserted in the channel 4. The male contact member 28 is connected to an electrical circuit and may include connecting means identical to those provided on the female electrical contact element.

Figure 2:
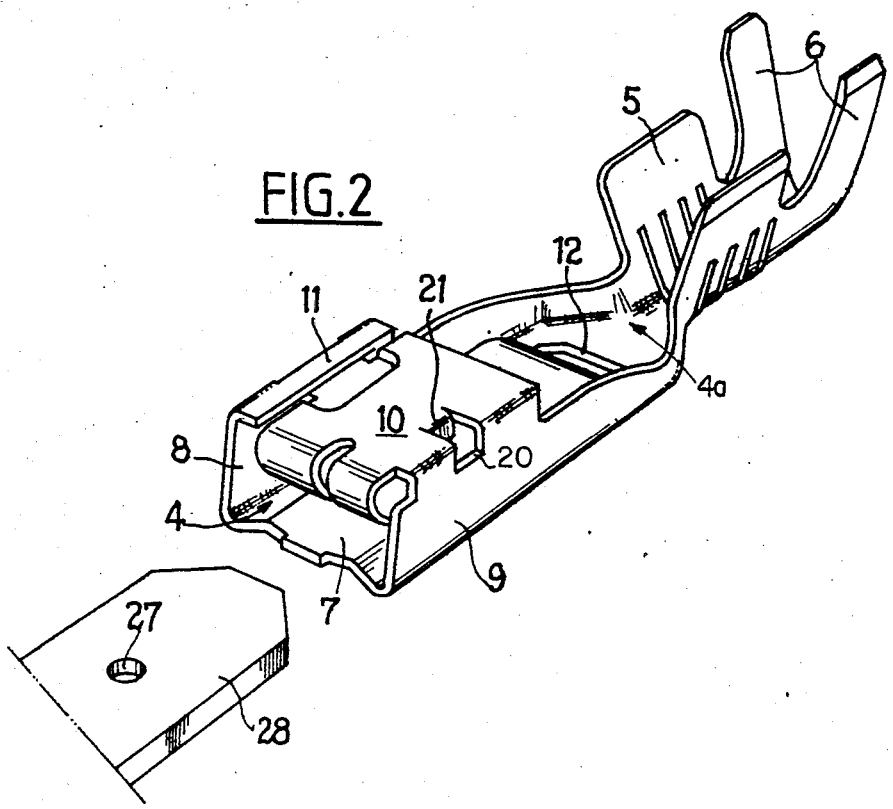
FIG. 2 is a perspective view of the female contact element blank folded into the form of the finished product.

The blank which is shown in FIG. 1 is adapted to be formed into the finalized end product, i.e., the female electrical connector element of the present invention, the different perspectives of which are shown in FIGS. 2–4, by folding the previously described sections along fold lines (illustrated using phantom lines in FIG. 1).

Considering the blank shown in FIG. 1 as being looked down upon, side walls 8 and 9 are folded upwardly along the general area represented by the fold lines towards the viewer in the formation of channel 4 of the female electrical connector element. the side walls 8 and 9 are preferably folded to lie in a plane which is substantially perpendicular to the plane of bottom wall 7. The tapered section **7*a* of the base wall 7 as well as tabs 5 and 6 are also folded in the same direction so as to form a trough 4*a*, preferably having a generally curved interior surface, the curve of which becomes progressively more pronounced towards tab 6 at the anterior end of portion 1** of the female electrical connector element.

The top wall section 10 may then be folded along the various fold lines shown as traversing between lateral edges **13*a* and 13*b* of the top wall section and lateral edges 14*a* and 14*b* of the tab 14 so as to impart the necessary configuration to the female electrical contact element required for purposes of the present invention. Preferably, the configuration of the channel portion of the female electrical contact element of the present invention is imparted prior to the previously described folding operations. In either instance, the tab 14 is folded downwardly along the fold line at the base of the tab adjacent extension 13 of the top wall 10 to form a catch in the shape of hook 14*c* and downwardly along the fold line towards the tip of the tab 14 to form a return 14*d* which is adapted to cooperate with opening 12 in bottom wall 7*a*** of the channel.

The elongate members 17 and 18 of the extension 13 of the top wall may then be folded upwardly so that the resultant tangs 17 and 18 and catch 14*c* are ultimately located within the channel in a manner which permits catch 14*c* to cooperate with opening 12 in base panel 7. Prior to folding elongate member 17 and 18 in the previously stated manner, lug tab 19, which projects laterally from an edge opposite the edge of elongate portion 18 adjacent slot 15*a*, would be folded upwardly so as to be adapted to contact lateral projection 10*a* of top wall 10 when force is applied against a surface of tang 18 by a male contact member.

The top wall 10, folded into the proper configuration, as previously described, is then folded along the fold line between the top wall section 10 and side wall section 9 so as to be essentially parallel to base 7 thereby forming the major portion of the top or roof of channel 4. In so doing, lateral projection 10*a* fits within the notch 2*c* provided in side wall section 8.

In order to complete the assembly, flange 11 is folded so as to be essentially parallel with base 7 and coplanar with top wall section 7 and forms a minor portion of the roof of channel 4. In addition, flange 11 functions in maintaing lateral projection 10*a* in position within notch 2*c* so as to secure the assembly together.

As a result of the previously described assembly, tangs 17 and 18 are folded into the interior of the channel and the catch 14 is inclined so that it passes through opening 12 in base 7. The lug 19 is extended inwardly towards the top wall 10 and the lug 21 is bent inwardly towards tang 17. As can be seen in more clearly FIGS. 1 and 2, the top wall is blocked in position by flange 11. When a male member 28 is inserted into the channel 4 of the female electrical connection element of the present invention, the male member is pressed against the base wall 7 by the tangs 17 and 18. In so doing, tang 17 makes the electrical connection whereas tang 18 may be pushed back by a force exerted on the free end of the catch 14 so as to engage the male member 28. Lug 21 is forced inwardly so as to be in position to abut elongate portion 17 when pressed towards top wall 10 by force applied against a surface fo elongate portion 17 by the insertion of a male contact member into channel 4. Because of the lugs 19 and 21, the tangs 17 and 18 cannot be bent beyond a certain degree and this prevents them being forced and damaged to the point that they are no longer able to resiliently bias against a male contact member to firmly hold the same in position.

From the foregoing description, one skilled in the art can easily ascertain the essential features of the present invention and, without departing from the spirit and scope thereof, can make various changes and modifications of the invention to adapt it to various usages and condition.

What is claimed is:

1. A female electrical contact element fabricated from thin sheet metal that is resilient and a good conductor of electricity comprising:

(a) An anterior portion at one end including means for attachment to an electrical conductor, and (b) a posterior portion at an opposite end including a channel having a substantially rectangular transverse cross-section adapted to receive a substantially flat male contact member, said channel comprising:

(i) a base provided with an opening adapted to receive a catch;

(ii) two side walls attached to said base; and (iii) a top wall, attached to one of said side walls, having an extended portion with a free end bent into a hook-shaped catch and folded so as to be positioned between said top wall and said base within said channel, said extended portion including a slot having a generally elongate area dividing said extended portion into two elongate members, wherein said elongate area of the slot has a longitudinal axis parallel to a longitudinal axis of said extended portion, and said slot further includes a transverse area having an axis offset by an angle from said longitudinal axis which opens into an edge of said extended portion, so that one of said two elongate members is a shorter member and the other of said two elongate members is a longer member, wherein said longer member is integral with said free end of the extended portion and is adapted to be engaged by a male electrical contact member, and wherein said shorter member is adapted to make electrical contact with a male electrical contact member.

2. The female electrical contact member in accordance with claim 1, wherein said longer member has a boss on a side facing said base.

3. The female electrical contact member in accordance with claim 1, wherein said longer member has a lug folded towards said top wall.

4. The female electrical contact member in accordance with claim 1, wherein said top wall includes a lug cut out and folded towards said shorter member.

5. A blank of sheet metal adapted to be formed into a female elctrical contact element composed of a posterior position shaped into a channel for receiving a male contact member and an anterior portion adapted to be attached to an electrical conductor, said blank comprising:

(a) a base section, including a forward extension having lateral projections adapted to be shaped into the anterior portion of the female electrical contact element to be attached to an electrical conductor, and having an opening adjacent said forward extension, said base section being adapted to act as a base panel of said channel;

(b) a first side section and a second side section, each said side section being integral with said base section and adapted to be formed into a first side panel and a second side panel of said channel;

(c) a flange section integral with said first side section adapted to be formed into a top wall panel of said channel; and (d) a top wall section including a rearward extension terminating in a free end adapted to be formed into a catch, said rearward extension of said top wall section being composed of:

(i) a first shorter elongate member, and (ii) a second longer elongate member integral with said free end of the rearward extension, said top wall section being adapted to be formed into a top wall panel of said channel.

6. The blank in accordance with claim 5, wherein said second longer elongate member of the rearward extension of the top wall section is provided with lateral projection adapted to be formed into a lug.

7. The blank in accordance with claim 6, wherein said second side panel section and said top wall section include a cut-out area adapted to be formed into a lug.

8. The blank in accordance with claim 7, wherein said first side wall section has a notched-out area and said top wall section is provided with a lateral tab adapted to fit within said notched-out area upon formation of said channel.

9. The blank in accordance with claim 8, wherein said second longer elongate member of the rearward extension has an area adapted to be formed into a boss.

* * * * *

UNITED STATES PATENT AND TRADEMARK OFFICE

CERTIFICATE OF CORRECTION

PATENT NO. : 4,696,530

DATED : September 29, 1987

INVENTOR(S) : Bertrand VANDAME

It is certified that error appears in the above-identified patent and that said Letters Patent is hereby corrected as shown below:

At column 1, line 32, change "angel" to ---angle---.
At column 1, line 40, change "in achieved" to ---is achieved---.
At column 5, line 21, change "maintaing" to ---maintaining---.
At column 5, line 28, change "seen in more cleerly" to ---seen more clearly in---.
At column 6, line 27, change "elctrical" to ---electrical---.

Signed and Sealed this

Second Day of August, 1988

*Attest:*

*Attesting Officer*

DONALD J. QUIGG

*Commissioner of Patents and Trademarks*